US007591153B2

(12) United States Patent
Huss

(10) Patent No.: US 7,591,153 B2
(45) Date of Patent: Sep. 22, 2009

(54) YARN DELIVERING APPARATUS HAVING A YARN RETURN OPERATING MODE

(75) Inventor: Rolf Huss, Lossburg (DE)

(73) Assignee: Memminger-IRO GmbH, Dornstetten (DE)

( * ) Notice: Subject to any disclaimer, the term of this patent is extended or adjusted under 35 U.S.C. 154(b) by 0 days.

(21) Appl. No.: 11/785,491

(22) Filed: Apr. 18, 2007

(65) Prior Publication Data

US 2007/0210198 A1 Sep. 13, 2007

Related U.S. Application Data

(63) Continuation of application No. PCT/EP2005/010754, filed on Oct. 6, 2005.

(30) Foreign Application Priority Data

Oct. 21, 2004 (DE) ..... 10 2004 051 520

(51) Int. Cl.
*D04B 15/48* (2006.01)

(52) U.S. Cl. ..... 66/132 R

(58) Field of Classification Search ..... 700/141; 66/71, 77, 64, 54, 57; 242/418.1, 418, 365.7
See application file for complete search history.

(56) References Cited

U.S. PATENT DOCUMENTS

| | | | | |
|---|---|---|---|---|
| 4,673,139 | A * | 6/1987 | Memminger et al. | 242/365.7 |
| 4,752,044 | A * | 6/1988 | Memminger et al. | 242/365.7 |
| 5,421,534 | A * | 6/1995 | Arnold et al. | 242/419.5 |
| 6,010,052 | A * | 1/2000 | Leins et al. | 226/44 |
| 6,079,656 | A | 6/2000 | Schmodde et al. | |
| 6,550,285 | B2 * | 4/2003 | Nishitani | 66/146 |
| 7,289,869 | B2 * | 10/2007 | Morita | 700/141 |
| 2002/0139152 | A1 * | 10/2002 | Nishitani | 66/125 R |
| 2005/0224619 | A1 * | 10/2005 | Barea | 242/365.7 |

FOREIGN PATENT DOCUMENTS

| | | |
|---|---|---|
| DE | 3429207 | 2/1986 |
| DE | 36 29 699 | 3/1988 |
| EP | 1 231 310 | 8/2002 |
| EP | 1 674 600 | 6/2006 |
| WO | WO-03/093550 | 11/2003 |

OTHER PUBLICATIONS

Korean Office Action with English-language translation dated Apr. 23, 2009.

* cited by examiner

*Primary Examiner*—Danny Worrell
(74) *Attorney, Agent, or Firm*—Venable LLP; Ralph P. Albrecht; Ryan M. Flandro

(57) ABSTRACT

A yarn delivering apparatus comprises a yarn delivering wheel having a drive, as well as a yarn storing device having a yarn. laying device which is provided with its own yarn layer drive. A control device controls both drives, providing for a pure positive operation of the yarn delivering wheel on the one hand, and a yarn return delivery during shuttling of the knitting machine, on the other hand. Further, such a configuration improves the dynamics of the yarn delivering apparatus.

26 Claims, 7 Drawing Sheets

YARN DELIVERING APPARATUS HAVING A YARN RETURN OPERATING MODE

Figure 1:
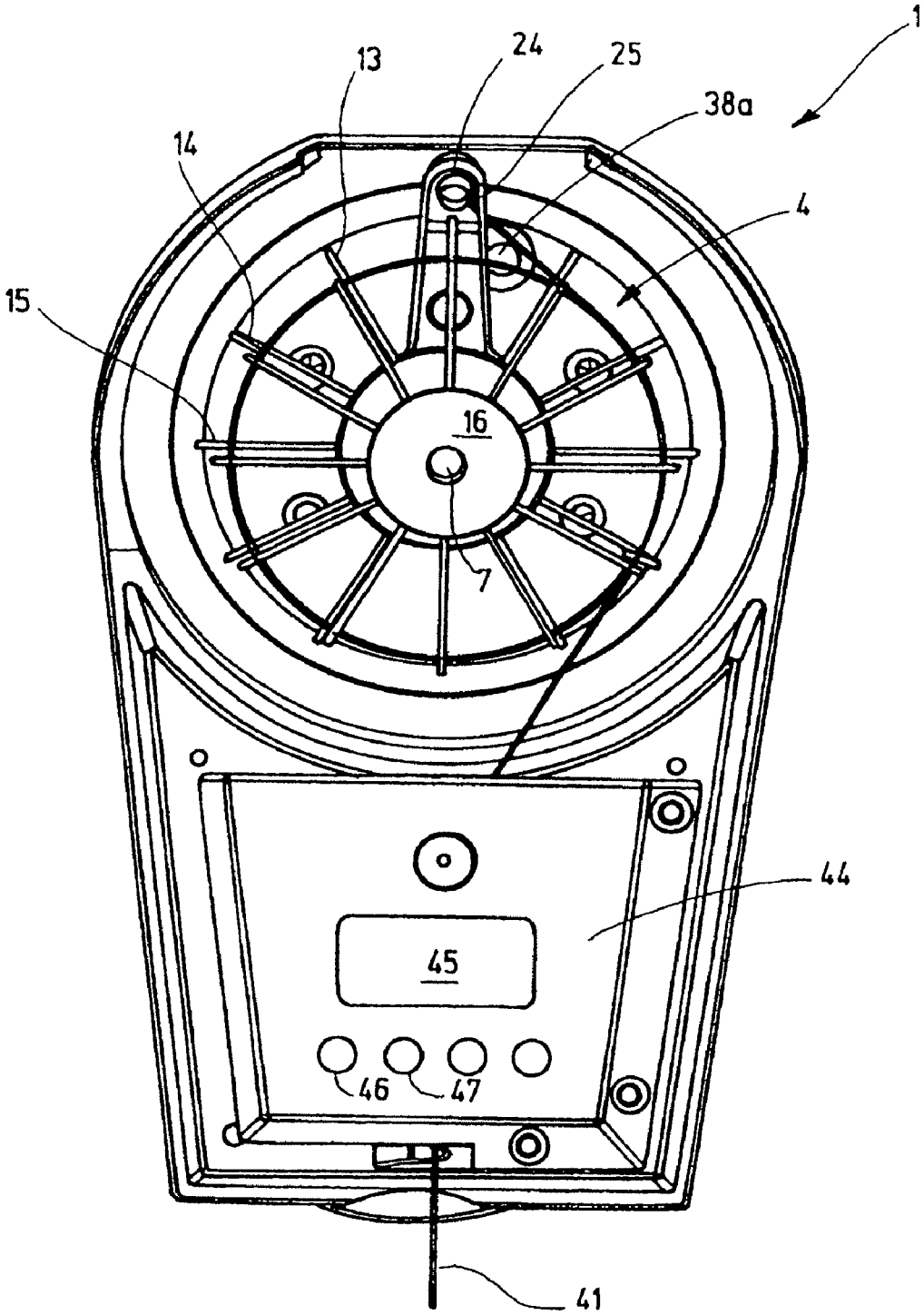

This application is a continuation of PCT/EP2005/010754 filed Oct. 6, 2005.

The invention relates to a yarn delivering apparatus which is adapted particularly for use in knitting machines or other yarn consuming machines which return yarn from time-to-time. Such machines are, for example, flat knitting machines having a reciprocating carriage; at least at one of the reversal points of the carriage a short yarn return delivery may take place. Yarn return delivery may also occur in flat knitting machines which have several knitting cams and yarns and where individual cams may be switched to idling for one or several strokes.

Further, frequent yarn return deliveries may occur in circular knitting machines, particularly when using the "fully-fashioned" technique. In such a technique not only are yarns inserted and dropped, but for certain knitted sections it may be required to rotate the knitting cylinder once or several times in the reverse direction to a greater or lesser extent. Such an operation, in which the knitting cylinder is rotated repeatedly forward and backward, is referred to as "shuttling". A yarn return delivery of 0.5 meter or more may occur. The yarn delivering apparatuses must take into account such yarn return deliveries.

German Patent Document DE 40 32 402 C2 describes a storage feeder for use in flat knitting machines, and combined with a separate dynamic yarn storing device. The yarn discharged by the storage feeder is guided to the flat knitting machine by a yarn storing device. The latter is formed by a long lever to which a torque is applied and which has a yarn eyelet at its free end. The lever is pivotally supported. Further, in the yarn path a yarn brake and a yarn tension sensor are arranged. The yarn quantity delivered back upon carriage reversal is taken up by first applying the controlled yarn brake, so that no further yarn can be withdrawn from the yarn storage feeder. Thereafter a torque is applied to the pivotal lever, as a result of which the lever takes up the yarn, delivered back by the flat knitting machine, by pulling lengthwise a yarn loop which has an acute angle.

Upon the subsequent carriage reversal, first the yarn reserve is consumed, and then the yarn brake is released for withdrawing yarn from the yarn storage feeder.

Such a mode of yarn storage is adapted particularly for yarn storage feeders where the knitting machine takes the yarn from the yarn storage feeder. This, however, is counter to the principle sought for the positive feeders to allocate a predetermined yarn quantity to the knitting machine.

An intermediate yarn storage is also feasible with the yarn delivering apparatus according to German Patent Document DE 37 32 102 C1 which discloses an electronically controlled positive feeder having a yarn delivering wheel around which the yarn is looped. The yarn running to the knitting machine is guided over a yarn storing device which includes a lever supported for a pivotal motion through almost 360°. The yarn passes through the eyelet of the lever. Within the circle described by the yarn eyelet, several yarn supporting elements are arranged which define a polygonal yarn storing device. In case between the yarn delivering wheel and the adjoining machine yarn remains which is not taken up by the machine, such a yarn quantity is deposited by the lever on the yarn supporting elements.

Such a mode of yarn delivery is adapted in particular for yarn delivery at a constant yarn tension.

Further, German Patent Document DE 34 29 193 C1 describes a device for unwinding yarns from a yarn spool and winding yarns thereon, wherein the yarn is guided by a winder finger on the yarn spool. The winder finger is mounted on a shaft which is concentric to the yarn spool and which is driven by an electric motor. The winder finger circulates about the outer periphery of the yarn spool. The electric motor may be controlled according to requirements in such a manner that the yarn is unwound from the yarn spool or wound back thereon. For the control, a yarn tensioning roller is provided by means of which the yarn tension is monitored. When yarn return delivery is required, the winder finger rewinds the yarn until the yarn tensioning roller is reset into its normal position by the tensioned yarn.

Yarn spools are, as a rule, combined on spool creels from which the yarns, as needed, are withdrawn only in a passive manner even for long sections. To involve the yarn spools in the active winding and unwinding steps is undesirable in many cases and is not even possible for larger distances between the yarn spools and the knitting machine.

It is accordingly an object of the invention to provide a yarn delivering apparatus which may process occasionally occurring yarn return deliveries in up-to-date knitting machines and other textile machines.

The above object is achieved with a yarn delivering apparatus which may include a yarn delivering wheel which, by means of a drive, may be rotated in two opposite directions for delivering the yarn. The yarn run is essentially tangential. A first direction of rotation serves as forward rotation in the normal operation for yarn delivery in a yarn delivering direction to a yarn consuming station. The reverse rotation serves in the yarn return operation for retrieving the yarn which returns from the yarn consuming station in the yarn return direction. Such yarn portion is then wound back onto the yarn delivering wheel. The yarn becoming free at the intake side of the yarn delivering wheel is intermediately buffered in a yarn storing device which, as viewed in the normal yarn delivering direction, is positioned upstream of the yarn delivering wheel between a yarn brake (if such is provided) and the yarn delivering wheel. The arrangement of the yarn storing device upstream of the yarn delivering wheel and in the immediate vicinity thereof preserves, on the one hand, the direct delivering conditions between the yarn delivering wheel and the knitting machine, so that the yarn delivering wheel may allocate the desired yarn quantity to the knitting machine or withdraw such quantity therefrom. On the other hand, the yarn is stored without having an appreciable influence on the tension in the wound yarn and in the portion between the yarn delivering wheel and the yarn consuming station.

The yarn storing device has preferably a yarn storing surface which is concentric to the yarn delivering wheel and which may be either a coherent, uninterrupted surface or an interrupted surface composed, for example, of several individual surfaces. Such individual surfaces may be, for example, supporting regions of pins or the like. The arrangement concentric to the yarn delivering wheel makes possible a uniform winding and unwinding, at a uniform tension, of the yarn delivered back from the yarn delivering wheel at its intake side. Preferably, with the yarn storing device a yarn laying device is associated which deposits the yarn, emanating from the yarn delivering wheel, on the yarn storing surface and withdraws the yarn therefrom. The yarn laying device may be a yarn guiding eyelet which is guided, for example, by a suitable lever along a path concentric to the yarn delivering wheel. Such an arrangement ensures a uniform winding and unwinding of the yarn without any appreciable tension fluctuations. Particularly in case of elastic yarns, the latter are prevented from being intermediately stored in different extended states. Further, the yarn, when it is again guided onto the yarn delivering wheel from the yarn storing device, is prevented from running onto the yarn delivering wheel with different, that is, with fluctuating tensions in the yarn winding. Thus, in an overall sense, the above-described concentric arrangement enhances the quality of the knitted fabric.

With the yarn laying device preferably a yarn layer drive is associated which is independent from the drive of the yarn delivering wheel. Both drives may be, for example, electric motors controlled by a control device which moves the yarn laying device and the yarn delivering wheel coordinated with one another. The control device distinguishes preferably among several operating conditions, for example, as defined in claim 10, according to which the control deice causes the yarn laying device and the yarn delivering wheel to move in the reverse direction at coordinated rpm's, so that the returned yarn is deposited on the yarn storing device without pulling new yarn into the yarn storing device. When resuming normal operation, first the thus-formed yarn reserve-is used up as the yarn delivering wheel and the yarn laying device rotate in the forward direction with coordinated rpm's. When the yarn reserve is consumed, the yarn laying device stops, for example, in a fixed position, and the yarn delivering wheel continues its forward rotation at unreduced speed. From the moment the yarn laying device stops, the yarn delivering wheel takes the yarn from the yarn spool.

The advantage of the above-described device resides in that an associated knitting machine may shuttle as frequently as desired without consuming any yarn. During each shuttle step the yarn is wound on the yarn storing device and then unwound therefrom. The speed of the yarn laying device and that of the yarn delivering wheel are coordinated with one another such that during the shuttle operation no yarn is supplied from the yarn spool and thus the total yarn quantity present in the yarn delivering apparatus does not increase. In the shuttle operation of the knitting machine, the yarn quantity of the yarn delivering apparatus oscillates between a maximum value and a minimum value which may differ from one another by more than 1 meter.

The drive for the yarn delivering wheel and that for the yarn laying device are constituted by respective electric motors, particularly by position-regulated electric motors. As an alternative, it is, however, feasible to provide a drive and a clutch arrangement between the yarn delivering wheel and the yarn laying device for connecting the yarn laying device with the yarn delivering wheel with fixed rpm's in each instance during charging and discharging the yarn storing device. In such a case the drive for the yarn laying device is composed of a drive/clutch/brake combination. Because of a better possibility of control, however, it is preferred to provide the yarn laying device with its own electric motor drive.

During normal operation the yarn delivering wheel is driven preferably with a predetermined speed which may be derived from the operating speed or rpm of the knitting machine. The yarn delivering wheel and the knitting machine are sought to be driven in synchronism in a given rpm ratio. Such an operation is referred to as a positive operation. In such an operation the yarn delivering wheel allocates the desired yarn quantity to the knitting machine and thus determines the loop size of the knitted fabric. To compensate for dynamic occurrences during starting and stopping of the yarn delivering wheel, between the yarn delivering wheel and the knitting machine a yarn storing device with a small storage capacity may be provided. Such a yarn storing device, however, does not serve for the intermediate storage of the returned yarn; for such a purpose its capacity is definitely insufficient. It is provided merely for buffering tension peaks which may otherwise appear during switch-on steps (starting and stopping of the yarn delivering wheel). As the simplest solution, such a yarn storing device is formed by a thin, light and resilient lever which holds a yarn loop.

The yarn return delivery may likewise be performed with a predetermined rpm of the yarn delivering wheel. It is, however, preferable to effect the yarn return delivery with tension control, that is, by controlling the yarn tension. In such an operation, during the shuttling of the knitting machine, the yarn delivering apparatus is continuously switched between positive drive and tension-controlled drive (positive drive for the normal operation and tension control for the yarn return operation).

The yarn laying device as well as the yarn delivering wheel are preferably coupled to angular position sensors. The control device is preferably provided with a counter or another monitoring device which counts the angular steps traveled by the yarn laying device, and preferably also counts the angular steps traveled by the yarn delivering wheel, particularly during the yarn return operation. In the alternative, the angle traveled by the yarn laying device as well as the yarn delivering wheel may be registered in a different manner. The control device thus monitors the quantity of the yarn intermediately buffered in the yarn storing device. The control device may switch over to normal operation with the yarn laying device at rest, when the entire forward-registered path has been traveled in reverse, or, in the alternative, when the yarn laying device has reached a fixed position. As the yarn laying device approaches its fixed position, its normal speed may be gradually braked to zero to prevent abrupt tension changes at the intake side of the yarn delivering wheel. In this manner the yarn running onto the yarn delivering wheel is relieved of stress. In cooperation with the pattern storing device of the knitting machine care can be taken that such a gradual braking takes place only when the shuttling operation is terminated, in order to avoid a gradual filling of the yarn storing device which would otherwise occur.

Control of the yarn delivering apparatus occurs preferably by the machine control, particularly its pattern storing device. The latter supplies data relating to the yarn quantities to be delivered which correspond to the rpm of the yarn delivering wheel, as well as relating to the moments of delivery start and delivery termination. The yarn delivering apparatus converts these values in a possibly error-free manner. It is also feasible to operate the yarn delivering apparatus in a self-learning manner. For this purpose, for,example, the yarn tension is, in a test run, held at a nominal value by tension control. In such a proceeding the rpm's of all the yarn delivering wheels of all the active yarn delivering apparatuses are monitored and a suitable mean value is determined as the nominal value for the subsequent positive operation.

During the positive operation, it is furthermore feasible to monitor the self-setting yarn tensions by a yarn tension sensor and if such tension deviates from a nominal value, to effect a follow-up setting of elements of the knitting machine. Such follow-up settings may also be limited to instances where the deviation exceeds a threshold value. Elements of the knitting machine to undergo follow-up setting may be the knitting cams or the product pull-off device. It is also possible to dispense with the follow-up setting of the knitting machine or its elements, and in case the yarn tension exceeds or falls below the threshold values of the yarn tension, to generate an alarm signal or a switch-off signal.

The yarn laying device may further be utilized for significantly improving the dynamics of the yarn delivering wheel. In this connection it has been found that in case of a sudden yarn requirement from zero speed to a high delivery speed, not only the drive and the yarn delivering wheel, but the entire yarn length from the yarn spool to the yarn consuming station have to be accelerated. In this procedure the yarn has to be accelerated and furthermore, the friction of adhesion has to be overcome. The yarn running onto the yarn delivering wheel on its intake side brakes the yarn delivering wheel. The acceleration of the yarn delivering wheel can be significantly improved by providing that the yarn laying device, shortly before such an acceleration phase, produces a small yarn reserve on the yarn storing device. Further, the yarn laying device, upon starting of the yarn delivering wheel, is also accelerated for supplying the yarn delivering wheel first with yarn from the yarn storing device and for delivering yarn to the yarn delivering wheel from the yarn spool only when the yarn laying device approaches its fixed position. The yarn storing device serves in this connection to positively disconnect the yarn delivering wheel, during its acceleration phase, from the yarn spool.

It is also feasible to effect an early start or stop of the yarn delivering wheel in anticipation of an abrupt increase or decrease in the yarn requirement (pattern in advance). In this manner the inertia of the yarn delivering wheel and connected components may be compensated for up to a certain degree, and yarn tension peaks or yarn tension drops may be reduced at the beginning or the end of yarn delivery.

Figure 2:
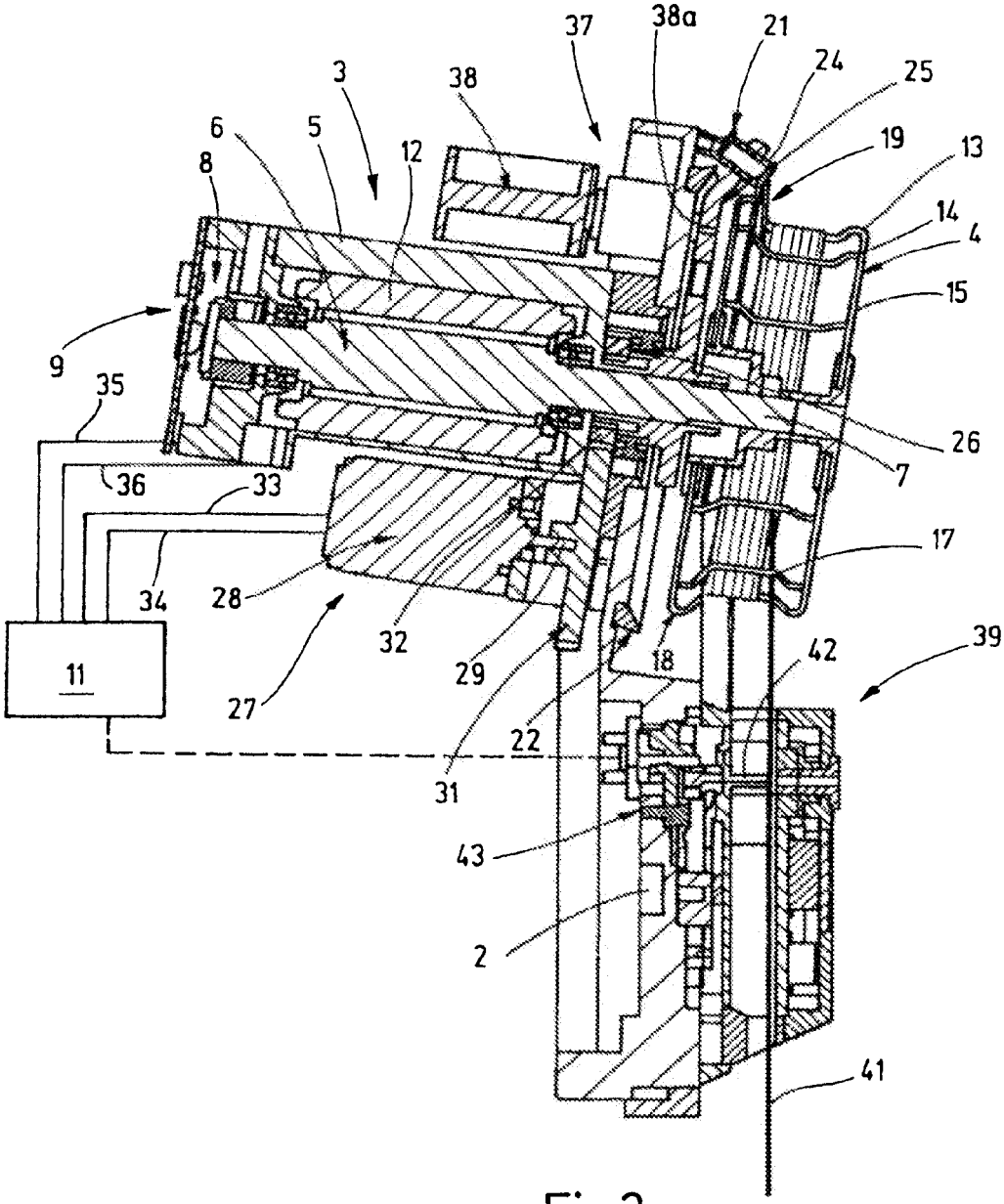
Figure 3:
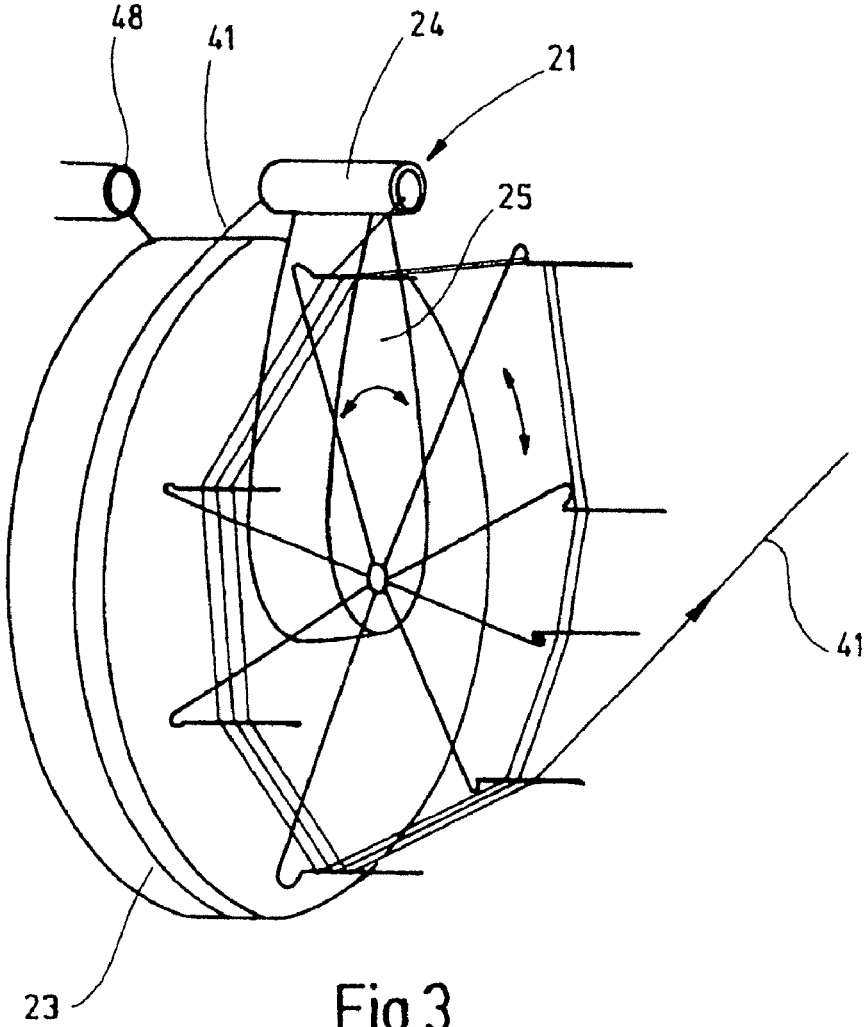
Figure 4:
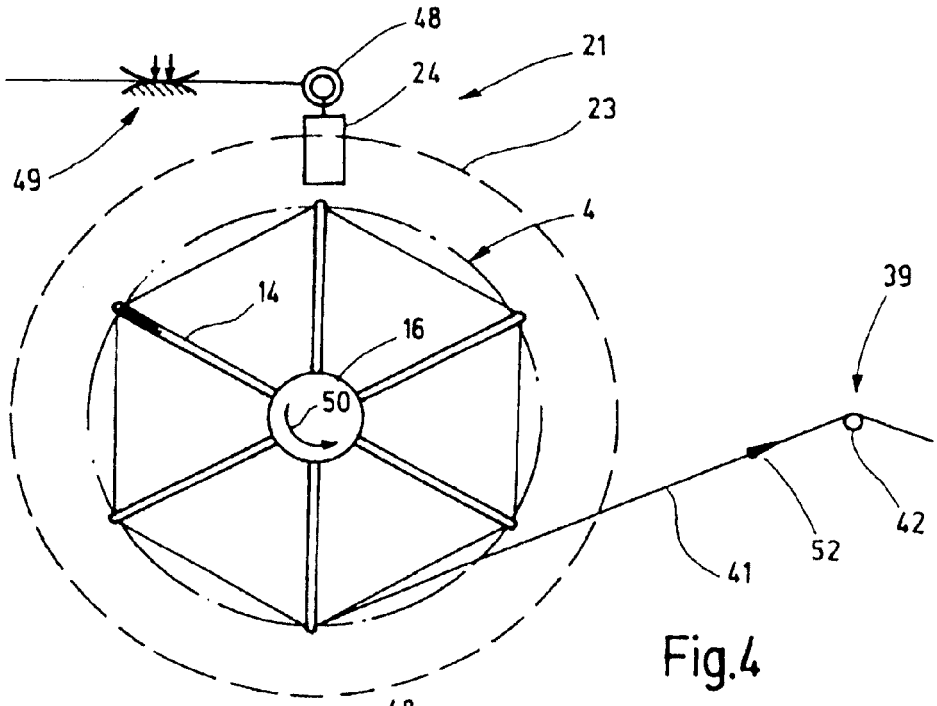
Figure 9:
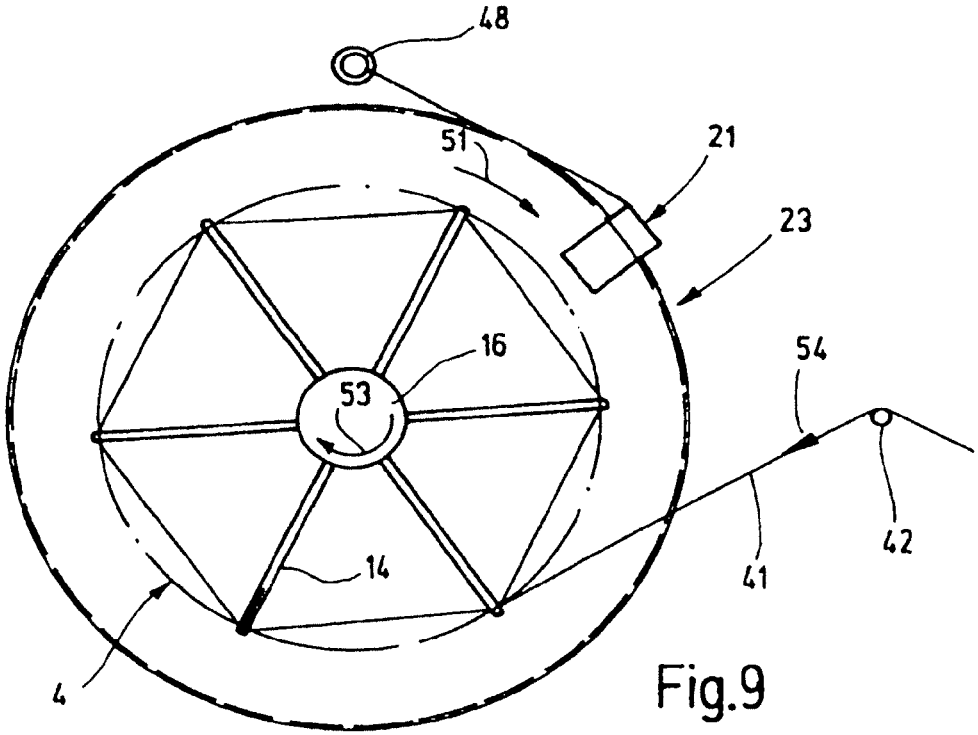
Figure 10:
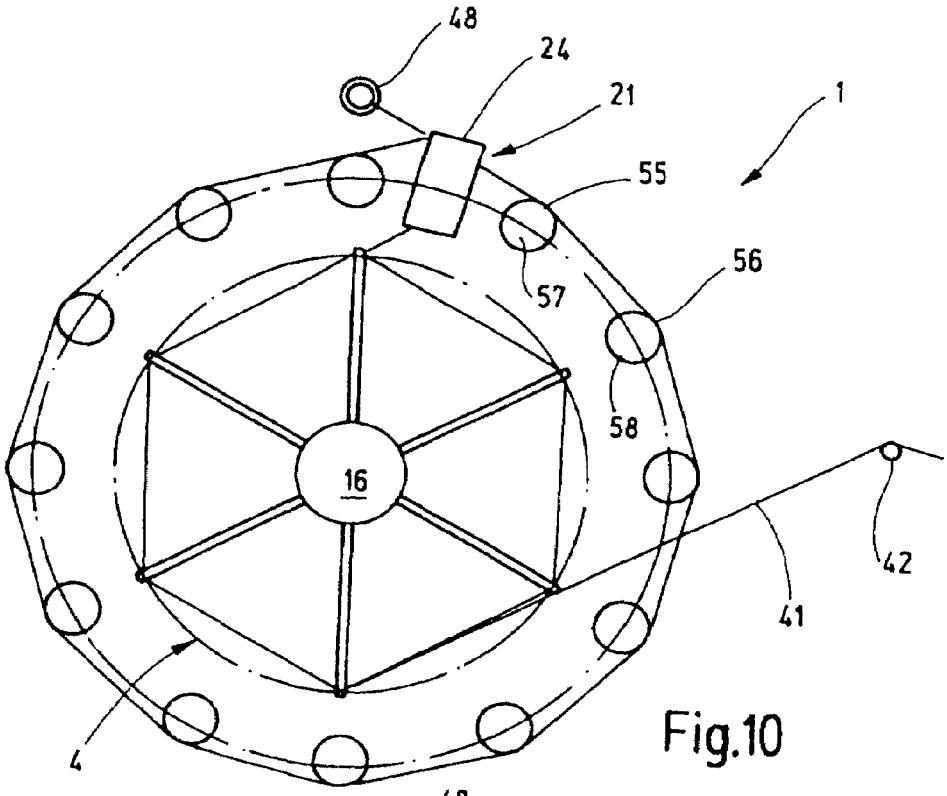
Figure 11:
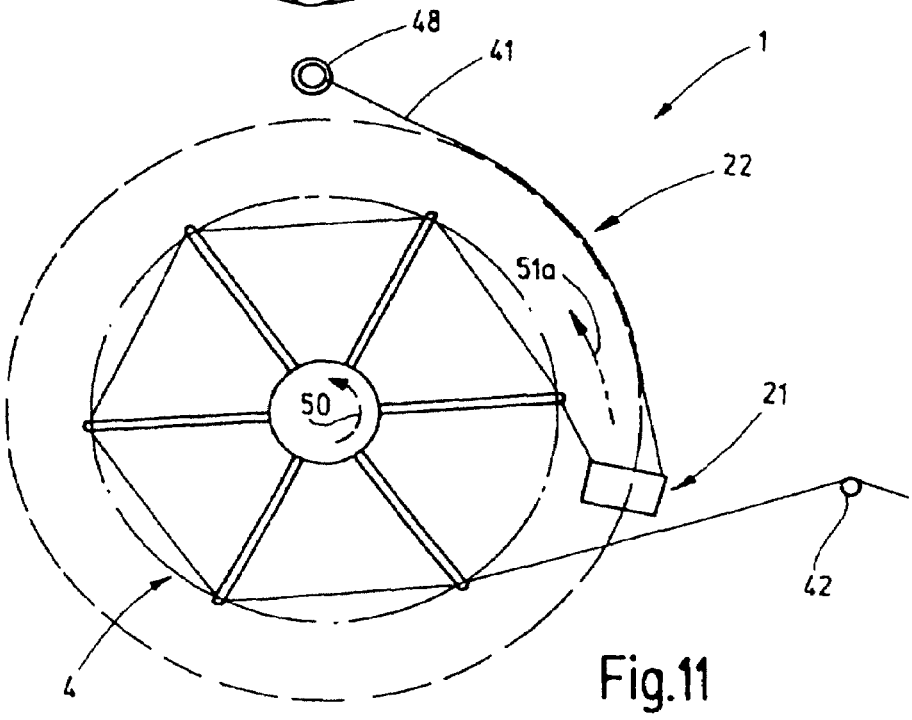

Further details of advantageous embodiments or further developments are disclosed in the drawing, the description or the claims. In the drawing, which illustrates embodiments of the invention, FIG. 1 is a front elevational view of a yarn delivering apparatus according to the invention, FIG. 2 is a longitudinal sectional and partially schematic view of the yarn delivering apparatus according to FIG. 1, FIG. 3 is a schematic perspective view of the yarn delivering apparatus according to FIGS. 1 and 2, FIG. 4 is a schematic illustration of the yarn delivering apparatus of FIGS. 1 to 3 in normal operation, FIGS. 5 to 9 show the yarn delivering apparatus of FIG. 4 in different positions in the yarn return delivery operation, FIG. 10 shows, a modified embodiment of the yarn delivering apparatus, and FIG. 11 shows the yarn delivering apparatus of FIG. 4 in a phase of start preparation before normal operation.

FIG. 1 shows a yarn delivering apparatus which serves, for example, for delivering hard (poorly elastic) or elastic yarns to flat knitting machines or circular knitting machines. The yarn delivering apparatus 1 is particularly adapted for delivering yarn to knitting machines which have a strongly fluctuating yarn requirement over time and/or which occasionally perform yarn return delivery. The yarn delivering apparatus 1 has, as also shown, for example, in FIG. 2, a carrier 2 on which a drive 3 is mounted for a yarn delivering wheel 4 shown as a hexagonal structure. In practice the yarn delivering wheel 4 may have several wings which form, for example, a hexagon. The drive 3 is, for example, an electric motor 5, whose armature 6 is connected with a drive shaft 7 carrying the yarn delivering wheel 4. For example, at its other end, the armature 6 may be coupled with an angular position sensor 8 which serves for detecting the actual angular position of the armature 6. The electronic circuit 9 of the angular position sensor 8 is connected to a control device 11 which serves for controlling the stator windings 12 of the electric motor 5.

The yarn delivering wheel 4 has a particularly low-inertia construction for permitting large rotational accelerations thereof. For this purpose, the yarn delivering wheel 4 has a number of identically structured, radially differently oriented wire yokes 13, 14, 15 (and additional, un-numbered yokes) which are supported by a hub 16 mounted on the drive shaft 7. The wire yokes are generally U-shaped having a central portion 17 for the yarn winding and further having, particularly at their sides oriented toward the drive 3, a radially outward directed projection 18 for the yarn winding. The projection 18 constitutes the intake side 19 of the yarn delivering wheel 4.

At the intake side 19 of the yarn delivering wheel 4 a yarn laying device 21 is provided which forms part of a yarn storing device 22. The yarn storing device 22 further comprises a preferably frustoconical yarn storing surface 23 which tapers away from the yarn delivering wheel 4 and which is concentric to the drive shaft 7. The yarn storing surface 23 is preferably significantly shorter in the axial direction of the drive shaft 7 than the portions 17 of the wire yokes 13, 14, 15.

The yarn laying device 21 bridges the axial distance between the yarn storing surface 23 and the intake side 19 of the yarn delivering wheel 4. For this purpose, the yarn laying device 21 has a tubule 24 which is made, for example, of ceramic and which constitutes a yarn eyelet. The tubule 24 is carried by a circulating lever 25 which is supported on the carrier 2 by at least one bearing 26 for rotation about an axis concentric to the drive shaft 7.

With the circulating lever 25 a yarn layer drive 27 is associated, comprising a position-regulated electric motor 28. The drive shaft 29 of the latter is connected with the circulating lever 25 by a gearing composed of two gears 31, 32. The electric motor 28 is controlled by the control device 11. For this purpose the control device 11 is connected by means of signal-carrying conductors 33 and control conductors 34 with the electric motor 28 for controlling the windings thereof. Corresponding signal-carrying conductors 35 and control conductors 36 are also provided for the electric motor 5.

With the yarn layer drive a locking device 37 may be associated for locking the circulating lever 25 in a fixed position. The locking device 37 may be actuated by an electromagnet 38 controlled by the control device 11. In case the yarn laying device 21 executes more than one revolution, the locking device 37 assumes its releasing state. For this purpose, for example, an abutment pin 38 a is provided which is movable by the electromagnet 38 between a locking position and an abutting position.

Further, the carrier 2 supports a yarn tension sensor 39 for detecting the tension of the yarn running therethrough. The yarn runs at an obtuse angle over a yarn supporting pin 42 forming a part of the yarn tension sensor 39. The yarn supporting pin 42 is coupled with a force-measuring device 43 which delivers a yarn tension measuring value to the control device 11 or any other suitable device. The yarn tension sensor 39 may be, as illustrated in FIG. 1, accommodated in a partial housing 44, on the frontal face of which a display 45 and several operating elements 46, 47 may be arranged. As may be observed particularly in FIG. 2, the yarn path defined by the partial housing 44 and the yarn supporting pin 42 is oriented at an obtuse angle to the rotary axis of the yarn delivering wheel 4.

As shown in FIG. 3, the yarn laying device 21 serves in particular to wind the yarn 41 onto the yarn storing surface 23 and to unwind the yarn 41 therefrom. In such an operation the yarn 41 is guided by a yarn intake eyelet 48 before it reaches the yarn storing surface 23. The yarn 41 may first run through a yarn brake 49 shown schematically only in FIG. 4. The yarn brake 49 is preferably an uncontrolled yarn brake which sets a constant yarn-pulling force. If required, however, a controlled braking force may be applied to the brake elements of the yarn brake 49. For this purpose, the brake elements are provided, for example, with an electric setting device (for example, an electric motor, an electromagnet, a piezo setting device or the like) controlled by the control device 11. The latter controls the yarn brake 49 preferably in such a manner that the braking force is increased when the yarn laying device 21 charges or empties the yarn storing device 22, whereas the braking force is reduced when the yarn storing device is empty and the yarn delivering wheel pulls yarn from the yarn spool to the knitting machine in the positive operational mode.

Preferably, upstream of the yarn brake 49 a non-illustrated intake stopper is positioned which operates preferably optically. However, a simple mechanical stopper formed as a sensor lever may also be used. A yarn monitoring ahead of the yarn delivering wheel. 4 is preferred to a monitoring after the yarn delivering wheel 4. The yarn tension sensor 39 is not well adapted for yarn monitoring, since even in normal operation, occasionally zero yarn tension magnitudes may appear. Further, it should be prevented in any event, that a ruptured yarn is fed into the machine.

It is further feasible to utilize the yarn laying device 21 as a stopper, that is, for monitoring the yarn. For this purpose, the force exerted by the yarn to the yarn laying device is monitored. If, as the yarn delivering wheel rotates, the force drops to an insufficient value or to zero, such an event is evaluated as a yarn rupture. In practice this may be realized, for example, by holding the yarn laying device 21 by the yarn a few millimeters away from the abutment (pin 38*a*), but elastically tensioned theretoward. If the yarn laying device abuts the pin 38*a*, such an event is detected by a suitable sensor and is evaluated as a yarn rupture.

The yarn delivering apparatus of FIGS. 1 to 3 operates in accordance with the functional description which follows.

The yarn delivering apparatus has several operational modes. FIG. 4, which is a substantially schematized representation for a succinct showing of conditions, illustrates the normal operation. The yarn storing surface 23 is shown only in broken lines for distinguishing it from a surface with yarn and a surface without yarn. In FIGS. 4 to 9 only a single wire yoke 14 of the yarn delivering wheel 4 is provided with a reference numeral for better following the rotation of the yarn delivering wheel 4. Further, the end of the referenced wire yoke 14 is shown blackened. Also, of the yarn laying device 21 only the tubule 24 is illustrated.

In the normal operational mode the yarn laying device 21 is at rest; it is in alignment with the yarn intake eyelet 48. The yarn delivering wheel 4 rotates, for example, counterclockwise, in the direction of arrow 50. The yarn 41 runs to a yarn consuming station in a yarn delivery direction as indicated by the arrow 52 tangentially away from the yarn delivering wheel 4 over a yarn tension sensor 39. As particularly well seen in FIG. 3, the yarn is looped several times around the yarn delivering wheel 4 and is thus fed in an essentially slip-free manner. However, slip-causing means, such as yarn lifting pins or the like may also be provided. Yarn slippage may also be effected by a slip clutch arranged between the drive shaft 7 and the yarn delivering wheel or by reducing the extent of yarn loop-around on the yarn delivering wheel 4. For example, slippage may be generated by merely positioning very few yarn turns about the yarn delivering wheel 4. It is also feasible to have the yarn contact the yarn delivering wheel 4 by less than an entire loop (for example, a ¾ loop-around). The control device 11 determines the rpm of the yarn delivering wheel 4 and thus sets the speed of yarn delivery and the quantity of the yarn delivered. This mode of operation is termed as the positive operational mode (with tangential yarn take-off).

When the yarn requirement of the associated knitting machine drops to zero, the yarn delivering wheel 4 stops, and thus no more yarn is delivered. From a stopped state a normal operation may be resumed at any time according to FIG. 4.

Figure 5:
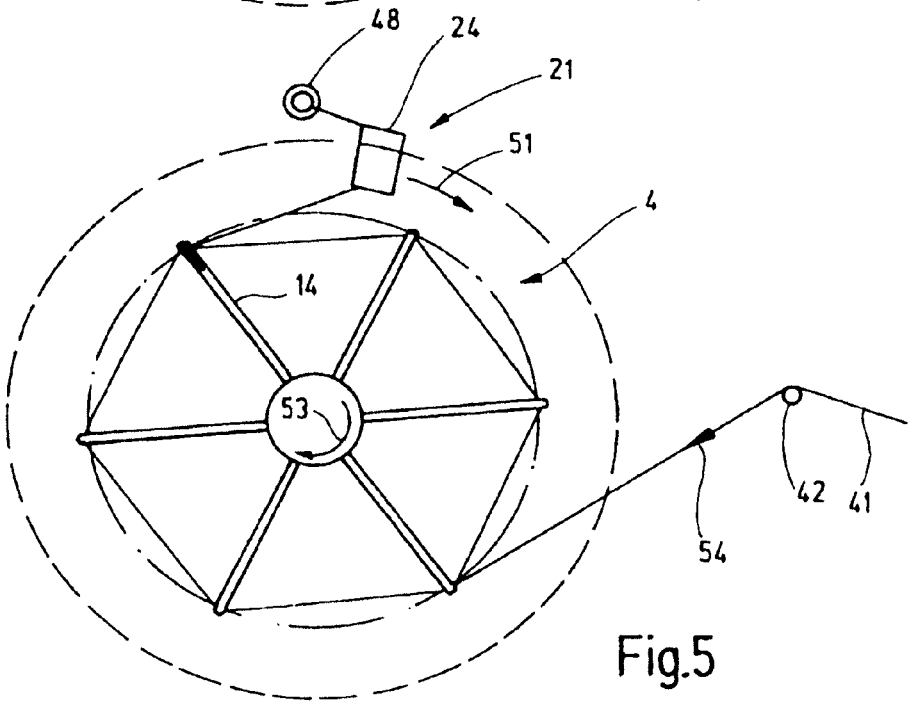

When the knitting machine or other machine begins to release the yarn 41, that is, it begins to feed it back, the yarn delivering apparatus begins its return delivery operation. The yarn delivering apparatus immediately determines a reduction in the yarn tension at the yarn supporting pin 42 and attempts to reinstate the yarn tension by reversing the drive 3. The latter thus executes a clockwise reverse rotation as indicated by arrow 53 shown in FIG. 5, and the yarn delivering wheel 4 takes up the yarn 41 in the return delivery direction as indicated by the arrow 54. The yarn 41 runs tangentially onto the yarn delivering wheel 4. As depicted in FIG. 5, the yarn delivering wheel 4 has already executed a 30° reverse turn which may be observed by comparing the positions of the wire yoke 14 in FIGS. 4 and 5. For preserving the yarn tension before the yarn delivering wheel 4, the control device 11 has triggered the operation of the yarn laying device 21, so that the tubule 24, as shown in FIG. 5, has been moved approximately 15° clockwise. In this manner the yarn length shown in FIG. 5 between the intake eyelet 48 and the wire yoke 14 exactly equals the sum of the yarn length present according to FIG. 4 between the intake eyelet 48 and the wire yoke 14 plus the back-fed yarn length. The motion of the yarn laying device 21 is effected preferably not with tension control, but "positively", that is, in accordance with a computed travel path determined from the detected reverse rotation of the yarn delivering wheel. No means are provided for detecting the yarn tension at the yarn laying device 21. If required, however, a tension-controlled actuation of the yarn laying device 21 is also possible.

Figure 6:
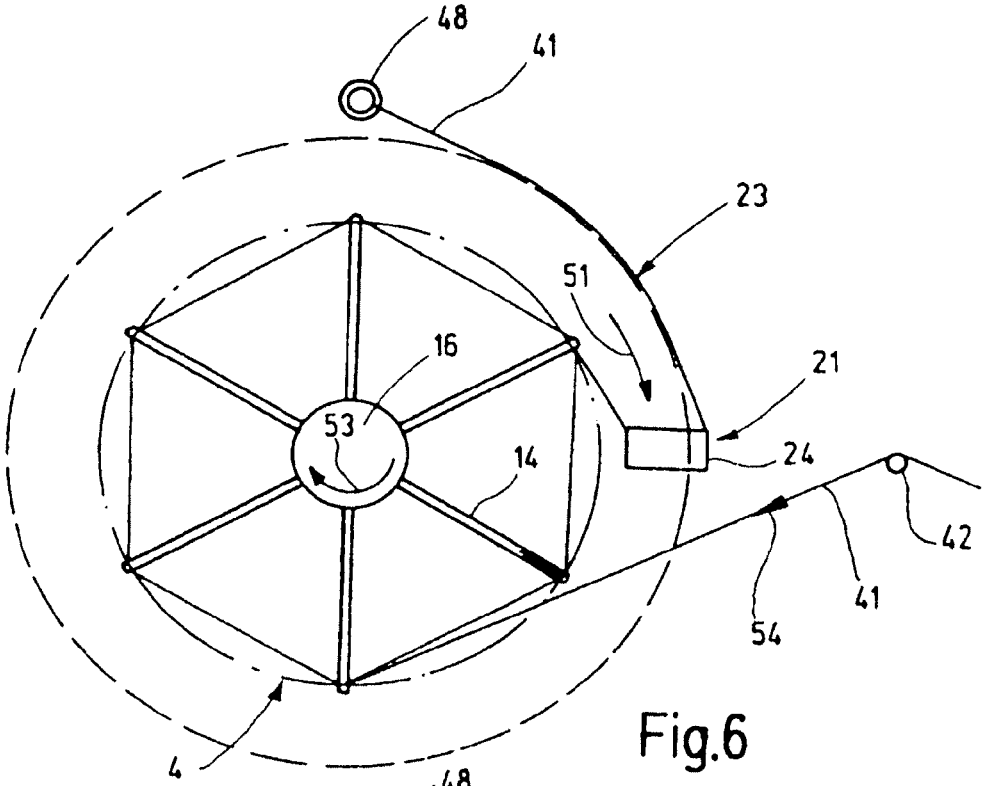

Upon a continued return feed of the yarn 41 the conditions according to FIGS. 6 to 9 prevail. As seen in FIG. 6, the tubule 24 of the yarn laying device 21 deposits the yarn 41 on the yarn storing surface 23. During yarn return delivery, the yarn laying device 21 runs significantly slower than the yarn delivering wheel 4. As depicted in FIG. 6, the yarn laying device 21 has executed an approximately one-quarter turn, while the wire yoke 14 and thus the yarn delivering wheel 4 have turned by more than one-half revolution.

Figure 7:
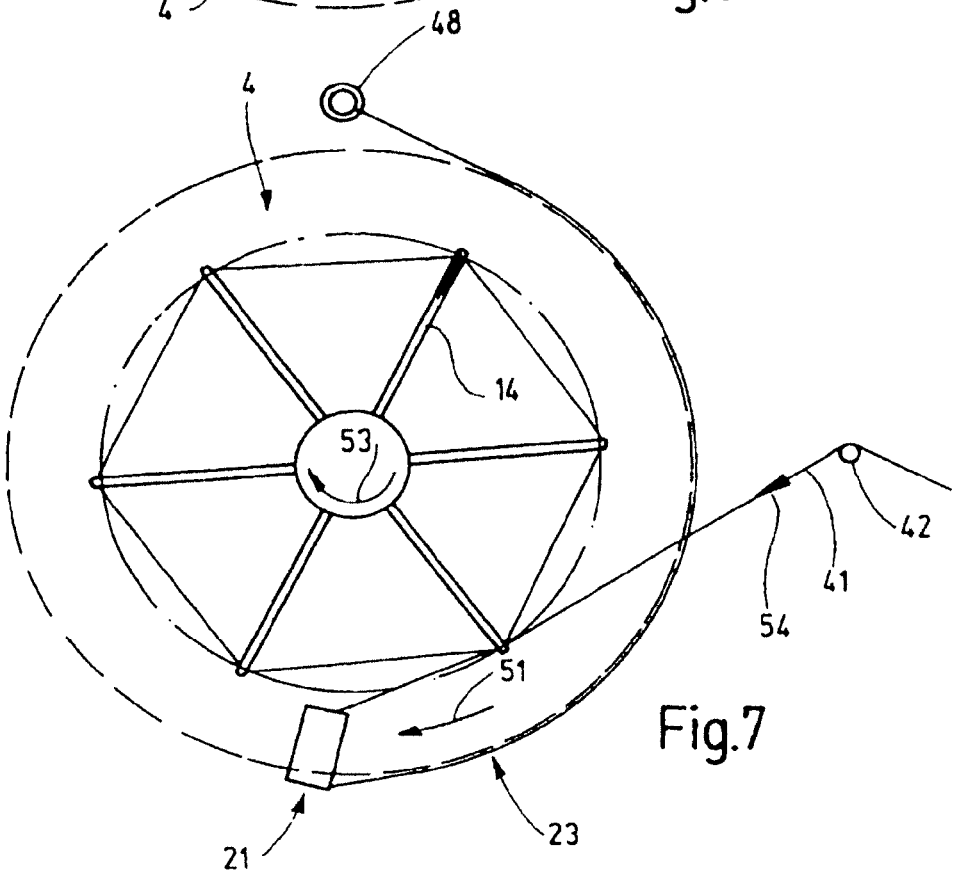
Figure 8:
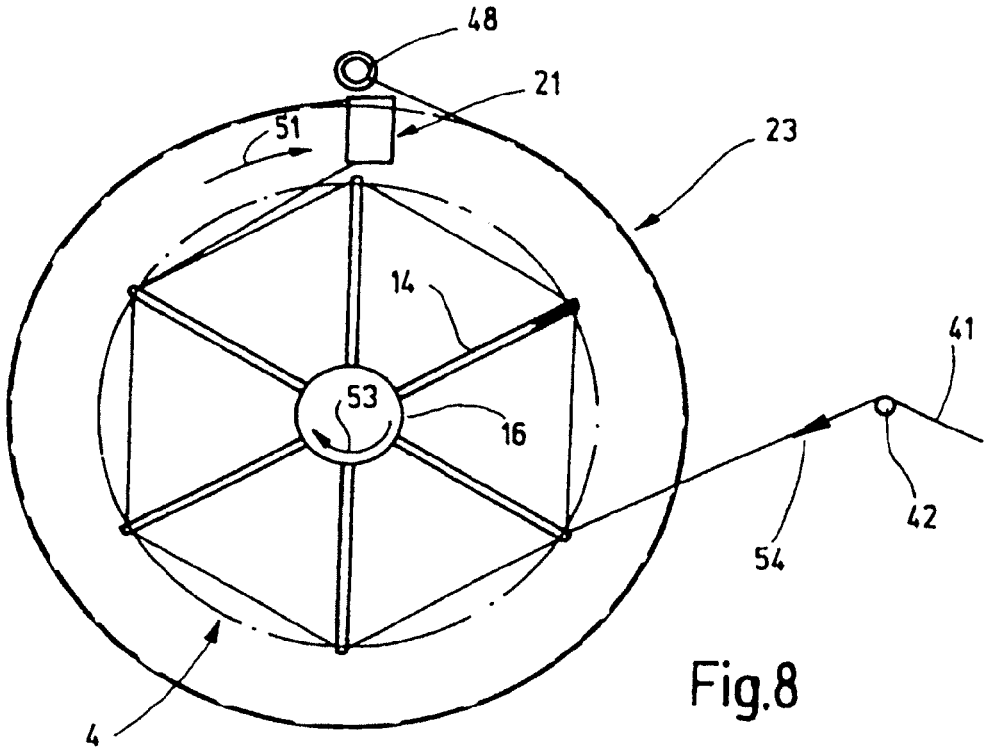

As shown in FIG. 7, a continued return delivery results in a gradual circulation of the yarn laying device 21 about the yarn storing surface 23 as the yarn delivering wheel 4 rotates, and the yarn storing surface 23 first receives one turn of yarn (FIG. 8) and further turns (FIG. 9), if required. Based on the conicity of the yarn storing surface 23, the yarn turns are deposited in the yarn storing device 22 side-by-side and are thus preferably not superposed. The rpm ratio of the yarn laying device 21 to the yarn delivering wheel 4, that is, the respectively traveled angles are computed by the formula $$\frac{\alpha}{\beta} = \frac{r_1}{r_2}$$

where $\alpha$ is the angle traveled by the yarn laying device,
$\beta$ is the angle traveled by the yarn delivering wheel,
$r_1$ is the diameter of the yarn storing device and
$r_2$ is the diameter of the yarn delivering wheel.

This arrangement ensures that no yarn is pulled through the yarn intake eyelet 48. In addition, the yarn brake 49 may be applied for preventing such yarn pull-off. xxx When the knitting machine stops the return delivery of yarn, the return delivery operation is terminated; this may occur, for example, in the position of the yarn laying device 21 and the yarn delivering wheel 4 shown in FIG. 9. If the knitting machine starts to take yarn, the yarn delivering apparatus changes into a modified normal operational mode in which yarn is no longer taken back in a tension-controlled manner, but rather, yarn is delivered to the knitting machine again in a quantity-controlled manner, that is, by means of predetermined rpm's set for the yarn delivering wheel 4. During this operation the directions indicated by arrows in FIGS. 9 to 5 are reversed. The yarn laying device 21 and the yarn delivering wheel 4 thus rotate clockwise in accordance with the above-defined angle and rpm ratio, whereby the yarn laying device 21 takes yarn off the yarn storing surface 23 and supplies it to the intake side 19 of the yarn delivering wheel 4. Again, no yarn is pulled through the yarn intake eyelet 48. This modified operational mode continues until the yarn storing device 22 is emptied, that is, until the tubule 24 has assumed its position in the vicinity of the yarn intake eyelet 48, as shown in FIG. 4.

Upon reaching this point, the yarn laying device 21 stops, while the yarn delivering wheel 4 continues to rotate unchanged. Thus, first a true normal operation is obtained. While in the modified normal operation only the yarn wound on the yarn storing surface 23 is again taken up and delivered to the yarn delivering wheel and thus to the knitting machine, yarn is now pulled off against the effect of the yarn brake 49. The yarn return operation and the modified normal operation may alternate arbitrarily often. No yarn is pulled from the yarn spool through the yarn brake 49 either during the yarn return operation or during the modified normal operation.

While according to the starting point in the preceding description the yarn layer drive 27 operates in an accurate position-regulated manner, it has to be noted that this does not necessarily need to be the case. It is also feasible to utilize an electric motor 28 which is not position-regulated and to monitor merely the position of one of the two gears 31, 32. In the simplest case it may suffice to provide on the gear 32 or also on the gear 31 one or more markers (bore holes) or magnets which are detected by optical sensors or, respectively, by magnetic sensors (Hall sensors). When the yarn delivering wheel 4 rotates in the reverse direction, the position or rotation of the yarn delivering wheel is detected, and the motor 28 is energized for moving the yarn laying device 21. The motor 28 may be supplied with a controlled current for generating a predetermined torque which should be smaller than the torque required for pulling yarn through the yarn brake 49. In this manner the yarn storing device 22 takes up yarn only from the yarn delivering wheel 4. When the yarn delivering wheel 4 reverses its direction of rotation to again empty the yarn storing device 22, it works against the slight tension of the yarn laying device 21. Such a tension may also be reduced by reducing the current supplied to the motor 28. When the yarn laying device 21 reaches its position (fixed position), for example, marked by the Hall sensor and the magnets on the gear 31 (or also on the gear 32), the yarn laying device 21 is braked to a stop, that is, it is arrested in its fixed position, and the yarn delivering wheel 4 pulls off new yarn from the yarn spool while overcoming the force of the yarn brake 49.

As a departure from the above description, it is to be noted that the modified normal operation which consumes the stored yarn reserve, as well as the normal operation which pulls yarn off the upstream-arranged spool, may proceed in a tension-controlled manner as controlled by the yarn tension sensor 39.

A modified embodiment of the yarn delivering apparatus 1 is schematically illustrated in FIG. 10. The modification resides in the configuration of the yarn storing surface 23 which, in this embodiment, is divided into individual surfaces 55, 56. These surfaces are formed by individual pins 57, 58 which are arranged as a crown in the vicinity of the yarn delivering wheel 4. In other respects the previous description applies.

The yarn delivering apparatus 1 makes possible a particularly rapid start and stop of yarn deliveries. For such a purpose a dynamic operational mode may be used which will now be described in conjunction with FIG. 11. As a starting point of the dynamic operational mode, prior to yarn delivery in the yarn storing device 22, a smaller yarn reserve is built up, for example, as shown in FIG. 11. The yarn reserve may even be smaller. It could be built up by rotating the yarn laying device 21 into the illustrated position during standstill of the yarn delivering wheel 4, for example, by a few degrees in a clockwise direction. During such a step, the yarn 41 is pulled through the yarn intake eyelet 48 and over the yarn storing surface 23. This may always occur preventively when the yarn delivering wheel 4 stops at the end of its normal operation. It may occur, controlled by the pattern storing device of the knitting machine, merely when a highly dynamic start, that is, an abrupt increase in the yarn requirement is expected.

FIG. 11 shows the yarn delivering apparatus in its state of preparation for a high-dynamic start. If now a starting signal is emitted by the knitting machine for the yarn delivering apparatus 1, the yarn laying device 21 and the yarn delivering wheel 4 are simultaneously accelerated in a counterclockwise direction (arrows 50, 51*a*). By means of the acceleration of the yarn laying device, the yarn delivering wheel 4 is first temporarily, that is, during its run-up phase, relieved of the load of the yarn which is otherwise pulled by the yarn delivering wheel 4 and which extends to the yarn spool. Thus, during the run-up phase, the yarn delivering wheel 4 merely has to overcome its own inertia and that of the yarn winding carried thereby. When the yarn delivering wheel 4 reaches its nominal rpm, for example, after a one-half or three-quarter revolution, the yarn laying device 21 arrives in its fixed position underneath the yarn intake eyelet 48 and is gradually, that is, softly, arrested there, until it comes to standstill. Such an operational mode avoids yarn tension peaks between the yarn delivering wheel 4 and the knitting machine in case of a sudden yarn requirement.

A yarn delivering apparatus 1 comprises a yarn delivering wheel 4 having a drive 3, as well as a yarn storing device 22 having a yarn laying device 21 which is provided with its own yarn layer drive 27. A control device 11 controls both drives 3, 27, providing for a pure positive operation of the yarn delivering wheel 4 on the one hand, and a yarn return delivery during shuttling of the knitting machine, on the other hand. Further, such a configuration improves the dynamics of the yarn delivering apparatus 1.

| List of Reference Characters: | |
|---|---|
| 1 | yarn delivering apparatus |
| 2 | carrier |
| 3 | drive |
| 4 | yarn delivering wheel |
| 5 | electric motor |
| 6 | armature |
| 7 | drive shaft |
| 8 | angular position sensor |
| 9 | circuit |
| 11 | control device |
| 12 | stator winding |
| 13, 14, 15 | wire yokes |
| 16 | hub |

-continued

| List of Reference Characters: | |
|---|---|
| 17 | portion |
| 18 | projection |
| 19 | intake side |
| 21 | yarn laying device |
| 22 | yarn storing device |
| 23 | yarn storing surface |
| 24 | tubule |
| 25 | circulating lever |
| 26 | bearing |
| 27 | yarn layer drive |
| 28 | electric motor |
| 29 | drive shaft |
| 31, 32 | gears |
| 33, 35 | signal carrying conductors |
| 34, 36 | control conductors |
| 37 | locking device |
| 38 | electromagnet |
| 38a | abutment pin |
| 39 | yarn tension sensor |
| 41 | yarn |
| 42 | yarn supporting pin |
| 43 | force measuring device |
| 44 | partial housing |
| 45 | display |
| 46, 47 | operating elements |
| 48 | yarn intake eyelet |
| 49 | yarn brake |
| 55, 56 | individual surfaces |
| 57, 58 | pins |
| 52 | yarn delivery direction (arrow) |
| 54 | yarn return delivery direction (arrow) |
| 51a, 50 | forward rotation (arrow) |
| 51, 53 | reverse rotation (arrow) |

The invention claim is:

1. A yarn delivering apparatus, for knitting machines having a yarn return operating mode, comprising:

a yarn delivering wheel having an intake side and a storing portion for receiving a yarn winding, a drive connected to the yarn delivering wheel and drivable in two opposite directions of rotation for delivering a yarn in a yarn delivery direction to a yarn consuming station in a normal operation during forward rotation, and for rewinding the yarn, returned from the yarn consuming station in a yarn return direction, on the yarn delivering wheel in a return delivery operation during reverse rotation, a yarn storing device arranged upstream of the yarn delivering wheel as viewed in the yarn delivery direction for intermediately storing the yarn returned by the yarn delivering wheel at a yarn intake side of the yarn storing device during reverse rotation, wherein the yarn storing device has a yarn storing surface concentric to the yarn delivering wheel, and a yarn laying device associated with the yarn storing device and including a yarn guiding eyelet guided in a circular path concentric to the yarn delivering wheel.

2. The yarn delivering apparatus as defined in claim 1, wherein the yarn storing device is disposed between a yarn brake and the yarn delivering wheel.

3. The yarn delivering apparatus as defined in claim 2, wherein the yarn brake is a controlled yarn brake, whose braking force may be switched by an electric control signal between at least two magnitudes.

4. The yarn delivering apparatus as defined in claim 1, wherein the yarn storing surface has a coherent structure.

5. The yarn delivering apparatus as defined in claim 1, wherein the yarn storing surface is divided into individual surfaces.

6. The yarn delivering apparatus as defined in claim 1, wherein a yarn layer drive is associated with the yarn laying device.

7. The yarn delivering apparatus as defined in claim 1, wherein the drive and the yarn layer drive are controlled by a control device which operates according the following control scheme:

a) during normal operation without previous yarn return operation the control device causes the yarn laying device to dwell in a fixed position and causes the drive to rotate in the forward direction, b) during yarn return operation the control device causes the drive to rotate in the reverse direction and causes the yarn laying device to rotate in the same reverse rotational direction at a reduced speed, and c) during normal operation with previous yarn return operation, the control device causes the drive to rotate in the forward direction and causes the yarn layer drive to rotate also in the forward direction, but at a reduced rpm, until the yarn laying device travels the path covered under b) and/or until the yarn laying device reaches the fixed position.

8. The yarn delivering apparatus as defined in claim 7, wherein the yarn laying device and the yarn delivering wheel run at rpm's which are at a fixed ratio to one another during rotation both in the forward and in the reverse direction.

9. The yarn delivering apparatus as defined in claim 8, wherein the rpm ratio is set in such a manner that the yarn length delivered by the yarn delivering wheel at its yarn intake side to the yarn storing device during yarn return operation equals the yarn length deposited in the yarn storing device.

10. The yarn delivering apparatus as defined in claim 1, wherein the drive is an electric motor.

11. The yarn delivering apparatus as defined in claim 10, wherein the drive is a position regulated electric motor.

12. The yarn delivering apparatus as defined in claim 6, wherein the yarn layer drive is an electric motor.

13. The yarn delivering apparatus as defined in claim 12, wherein the electric motor is a position-regulated electric motor.

14. The yarn delivering apparatus as defined in claim 1, wherein a yarn tension sensor is disposed between the yarn delivering wheel and the yarn consuming station.

15. The yarn delivering apparatus as defined in claim 1, wherein the drive is driven at a predetermined rpm in the positive delivering operational mode at least during normal operation.

16. The yarn delivering apparatus as defined in claim 15, wherein the predetermined rpm is set to be proportional to an rpm of the knitting machine.

17. The yarn delivering apparatus as defined in claim 1, further comprising a yarn tension sensor disposed between the yarn delivering wheel and the yarn consuming station, and a control device which drives the drive in normal operation in the positive operation and in yarn return operation in the yarn tension regulating operation.

18. The yarn delivering apparatus as defined in claim 17, wherein during the positive operation the rpm of the drive equals to a predetermined rpm at least within predetermined limits of the yarn tension.

19. The yarn delivering apparatus as defined in claim 17, wherein during the yarn return operation the rpm of the drive is set by the control device based on the yarn tension in such a manner that the yarn tension remains possibly constant during the yarn return operation.

20. The yarn delivering apparatus as defined in claim 17, wherein a dynamic yarn storing device is provided between the yarn delivering wheel and the yarn consuming station.

21. The yarn delivering apparatus as defined in claim 17, wherein the yarn storing device, a drive of the yarn storing device, the yarn delivering wheel and its drive are carried by a common carrier.

22. The yarn delivering apparatus as defined in claim 21, wherein the drive of the yarn storing device and the drive of the yarn delivering wheel are accommodated in a common housing.

23. The yarn delivering apparatus as defined in claim 1, wherein a control device for the drives is disposed in the housing.

24. The yarn delivering apparatus as defined in claim 1, wherein the yarn storing device comprises a circulating lever which carries the yarn guiding eyelet at its free outer end and the pivotal or rotary axis of which is coaxial with the rotary axis of the yarn delivering wheel.

25. The yarn delivering apparatus as defined in claim 1, wherein a slippage-causing device is provided between the drive and the yarn.

26. The yarn delivering apparatus as defined in claim 1, further comprising a yarn tension sensor disposed between the yarn delivering wheel and the yarn consuming station, wherein the drive is driven in a positive operation in the normal operation, and in a tension regulating operation in the return delivery operation.

* * * * *